United States Patent [19]

Parzanici

[11] 4,315,682

[45] Feb. 16, 1982

[54] XEROGRAPHIC TONER FIXING STATION

[75] Inventor: Remo E. Parzanici, Longmont, Colo.

[73] Assignee: International Business Machines Corporation, Armonk, N.Y.

[21] Appl. No.: 182,153

[22] Filed: Aug. 28, 1980

[51] Int. Cl.[3] ..... G03G 15/00

[52] U.S. Cl. ..... 355/3 FU; 219/216; 226/181; 226/181;188

[58] Field of Search ..... 355/3 FU; 219/216, 388

[56] References Cited

U.S. PATENT DOCUMENTS

| | | | |
|---|---|---|---|
| 3,707,215 | 12/1972 | Familant | 101/228 X |
| 3,945,726 | 3/1976 | Ito et al. | 219/216 X |
| 3,995,551 | 12/1976 | Mitter | 101/118 |
| 4,124,156 | 11/1978 | Waffner | 226/25 |
| 4,163,892 | 8/1979 | Komatsu et al. | 219/216 |
| 4,172,975 | 10/1979 | Noda | 219/216 |

OTHER PUBLICATIONS

*British Journal of Applied Physics,* vol. 9, Nov. 1958 pp. 428–433.

*Primary Examiner*—R. L. Moses

*Attorney, Agent, or Firm*—M. s. Bigel; J. Jancin, Jr.; N. L. Medlock

[57] ABSTRACT

A fuser roll apparatus in a toner fixing station associated with an electrophotographic or xerographic device for fixing a toner image onto a copy sheet by the application of heat and pressure. The fusing apparatus includes a heated fuser roll and a pair of smaller, spaced backup rolls, each of the backup rolls having a peripheral surface covering of a different elastic modulus from the other. The backup rolls are arranged so as to cooperate with the heated fuser roll to define two fusing nips through which a copy sheet sequentially passes. The downstream roll has the harder peripheral surface covering. As the copy sheet passes through the two nip areas in succession, the downstream backup roll tends to pull against the upstream backup roll. Thus, the copy sheet is tensioned as it passes over the portion of the surface of the heated fuser roll between the two backup rolls.

11 Claims, 2 Drawing Figures

XEROGRAPHIC TONER FIXING STATION

TECHNICAL FIELD

This invention relates generally to a toner fixing station associated with a xerographic or electrophotographic device and, more particularly, to such a toner fixing station wherein a fuser apparatus comprises a heated fuser roll and a pair of spaced, smaller backup rolls, each of the backup rolls being of a different surface hardness from the other.

BACKGROUND ART

In the process of xerography, a light image corresponding to the original to be copied is typically recorded in the form of a latent electrostatic image upon a photoconductive member. This latent image is developed, that is to say made visible, by the application of a pigmented thermoplastic resin, commonly referred to as toner. The visible image is thereafter transferred from the photoconductive member onto a copy sheet, such as, for example, paper. The copy sheet is subsequently passed through a fusing apparatus which affixes the image onto the copy sheet and is later discharged from the machine as a final copy.

One approach to fixing the toner particles onto the copy sheet has been to pass the copy sheet with toner images thereon, through a fusing nip formed by a heated fuser roll and a backup roll, the copy sheet being so oriented that the side thereof bearing the toner image contacts the heated fuser roll. As it passes through the nip, the copy sheet is simultaneously pressed and heated so that the toner becomes softened and firmly attached to the copy sheet.

As compared to other thermal fusing techniques, the heated roll type is considered more efficient as the time required for fusing the toner image onto the copy sheet is substantially reduced by providing for the simultaneous heating and direct compression of the toner image. Further, the size of the copying apparatus can be minimized due to the reduced space required for heated roll type fusing assemblies.

One of the disadvantages of such a fusing arrangement, however, is the relatively narrow surface temperature range that must be maintained by the heated fuser roll in order to properly fuse the toner image onto the copy sheet. If the surface temperature of the heated fuser roll is allowed to fall below this optimal range, a phenomenon referred to in the printing art as "offset" often results, i.e., wherein toner adheres to the roller surface and is transferred to the next copy sheet. Similarly, where the surface temperature of the heated fuser roll is higher than the optimal fusing temperature, the toner becomes over-fused and adheres to the roller surface simultaneously with fusion onto the copy sheet so that the adhered toner is transferred to the next copy sheet. Overheating may additionally result in paper jamming, as the copy sheet will tend to follow the heated fuser roll, rather than continuing along the intended paper path beyond the fuser station.

It is also essential in such a toner fixing arrangement so as to insure proper fusing of the toner image, that adequate pressure be applied between the heated fuser roll and the backup roll while the copy sheet is disposed therebetween. Further, since the fusing of the toner image is effected by a single application of heat and pressure, it is important that the heated fuser roll and backup roll be positioned axially parallel to each other so that there is minimal variance in the degree of fusion.

Known techniques of fuser roll design indicate the desirability of (1) providing a heat source internal of the heated fuser roll to minimize heat loss, (2) providing a deformable surface on the heated fuser roll to minimize the sticking of fused copies thereto, and (3) maximizing the "footprint" or impression made by the backup roll into the deformable surface of the heated fuser roll to maximize time for heat transfer. It has been recognized, however, that in many instances, the various design techniques are mutually conflicting. For example, maximization of the "footprint" increases the resident time of the copy sheet against the heated fuser roll surface. Consequently, fusing may then be achieved at a reduced operating temperature with an accompanying improvement in energy efficiency. Obviously though, the force or stresses applied by the backup roll as it contacts the heated fuser roll must be increased to produce this "larger" footprint, a consequence that may not be so desirable as the durability of the rollers can be measured as a function of the mechanical stresses thereon.

Similarly, the deformable surface material desirable for the heated fuser roll so as to provide the best separation of copy therefrom, conflicts with the criteria necessary to achieve the best heat transfer through the heated fuser roll surface from an internal heat source. Materials considered best suited to providing the deformable surface of the heated fuser roll, such as, for example, silicone polymers and elastomers, have only fair heat conducting properties. Thus, to obtain an efficient heat conducting path, it is necessary to limit the thickness of the deformable surface. Prevention of sticking on the other hand, is enhanced by a thick deformable surface layer of these materials. Further, a relatively thin deformable surface layer limits the total size of the footprint and also increases the force and attendant stresses required to develop a footprint of any given size.

Accordingly, it is a principal object of this invention to provide an improved xerographic toner fixing apparatus.

It is another object of this invention to provide a toner fixing apparatus capable of fusing a toner image onto a copy sheet at a reduced temperature and applied pressure and applied load.

It is a further object of this invention to provide a toner fixing apparatus wherein fusing may be achieved within a broader operating temperature and pressure range than heretofore.

Still another object of this invention is to provide a toner fixing apparatus which is easily fabricated.

DISCLOSURE OF INVENTION

The embodiment disclosed of the present invention provides an improved fuser roll apparatus in an electrophotographic or xerographic device having a heated fuser roll and two smaller backup rolls. In accordance with the invention, the two backup rolls are positioned in a spaced relationship so as to cooperate with the heated fuser roll to define two fusing nips. The backup rolls are designed so as to differ in peripheral surface hardness. By providing the upstream backup roll with a softer peripheral surface covering than that of the downstream backup roll, a copy sheet is caused to pass between the nip formed by the upstream backup roll and the heated fuser roll at a speed which is slightly less than that at which the sheet passes through the nip formed by the downstream backup roll and heated fuser roll. As the copy sheet passes through the two contact areas in succession, the downstream backup roll tends to pull against the upstream backup roll, thereby causing the tensioning of the copy sheet as it passes over the portion of the surface of the heated fuser roll between the two backup rolls. The arrangement thus effectively produces a long nip area extended between the two contact points.

BRIEF DESCRIPTION OF THE DRAWING

The invention will now be particularly described, by way of example, with reference to the accompanying drawing in which.

BEST MODE FOR CARRYING OUT THE INVENTION

Figure 1:
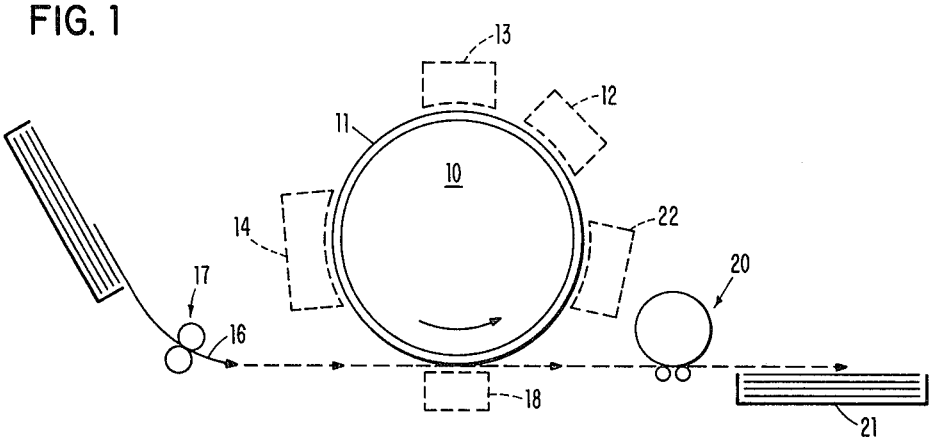
FIG. 1 is a schematic representation of a xerographic copying apparatus having a fuser roll fixing station incorporating the features of the present invention therein.

Referring to FIG. 1, there is depicted schematically, the various components of a typical xerographic copying apparatus in which the features of the present invention may be implemented.

Inasmuch as the art of xerographic copying is well known, the various processing stations for producing a copy of an orignal document are represented in FIG. 1 in block form, and are defined in terms of functionality.

Still referring to FIG. 1, the xerographic copying apparatus includes a rotatable drum 10 having a photoconductive surface 11. As the drum rotates in a counterclockwise direction, photoconductive surface 11 is caused to pass sequentially through a series of xerographic processing stations.

The first of these stations is a charging station 12 where a uniform electrostatic charge is deposited onto the photoconductive surface.

The second, exposure station 13, includes an exposure mechanism having a stationary housing for supporting the original (i.e., master) document to be copied. Thus, and by way of example, the original document may be scanned by oscillating a mirror (not shown) in a timed relationship with the movement of drum 10 to form a light image thereof. This light image is thereafter projected onto the charged portion of photoconductive surface 11. In this manner, the charge in the exposed areas of surface 11 is dissipated, thereby forming a latent electrostatic image on surface 11 which corresponds to the informational areas of the original document.

The latent electrostatic image recorded on photoconductive surface 11 is then rotated to development station 14 where xerographic developing material, including toner particles having an electrostatic charge opposite that of the latent electrostatic image, is applied to the latent electrostatic image to form a toner powder image on the photoconductive surface.

With continued reference to FIG. 1, a copy sheet 16 is advanced by sheet feeding apparatus 17 to transfer station 18. Sheet 16 is advanced into contact with drum 10 in a timed sequence so that the toner powder image developed on photoconductive surface 11 contacts the advancing copy sheet at transfer station 18. Once the toner powder image is transferred to sheet 16, the sheet is advanced to toner fixing assembly 20, where the toner powder image is permanently affixed to the copy sheet. The detailed operation and construction of the toner fixing assembly will be described hereinafter in greater detail with reference to FIG. 2.

Once the fusing operation is completed, the finished copy sheet passes to an output tray 21. The surface of drum 10 is thereafter cleaned at drum cleaning and discharge station 22 in preparation for the next copy cycle.

Figure 2:
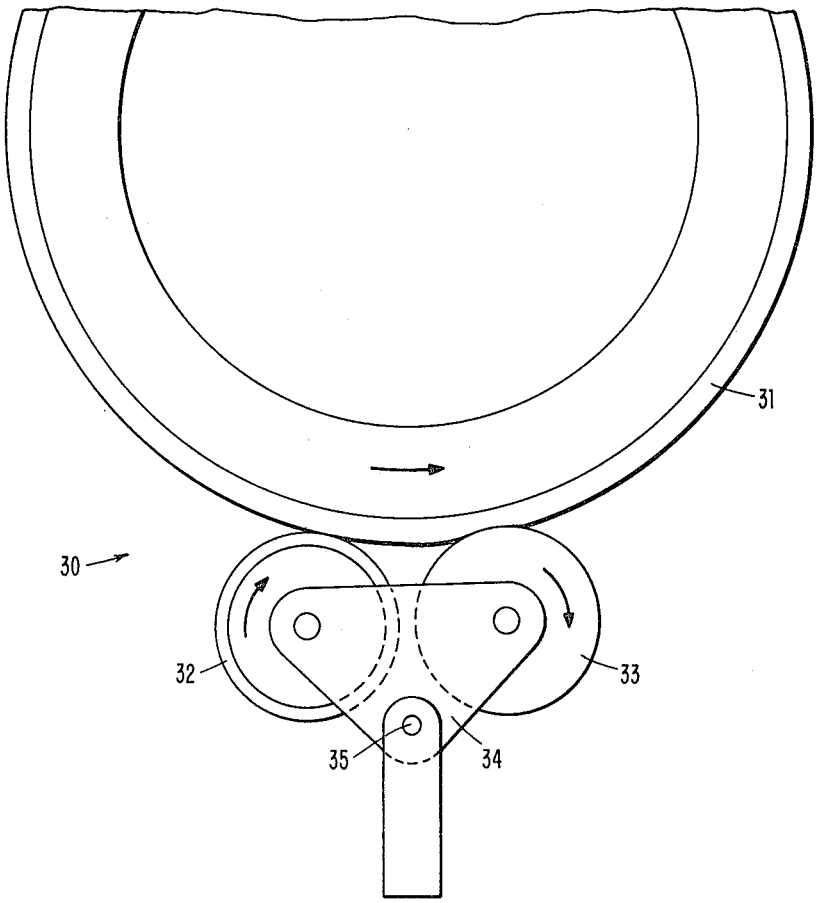
FIG. 2 is a schematic representation of the fuser roll apparatus including a heated fuser roll and a pair of backup rolls of differing surface hardness.

Referring now to FIG. 2, fuser assembly 30 includes a heated fuser roll 31 and a pair of smaller, spaced backup rolls 32, 33. Heated fuser roll 31 cooperates with backup rolls 32, 33 to define two fusing nips through which a sheet of copy material having a toner image thereon sequentially passes. The copy sheet (e.g., sheet 16 in FIG. 1) is so oriented that the side thereof bearing the toner image contacts heated fuser roll 31 as it passes through the two contact areas. Each of rollers 31, 32, 33, is rotatably mounted. Heated fuser roll 31 is driven by an associated drive motor (not shown). Backup rolls 32, 33 are mounted on a metal plate 34 and are arranged so as to rotate in peripheral contact under load with the driven heated fuser roll. Backup rolls 32, 33 are mounted so as to be stationary relative to each other. Plate 34 is, however, free to rotate about a pivot point 35 relative to the load applying member. Accordingly, when backup rolls 32, 33 are brought into contact with heated fuser roll 31, the load distributes itself automatically. This self-alignment feature has the advantage of creating a simple mechanical system which is easily fabricated.

It has been noted in the field to which the present invention pertains, that in a roller system consisting of a pair of relatively incompressible rollers, one hard roll and one soft roll, rotating in contact under load, that the hard roll always has the higher peripheral speed. G. J. Parish in an article published in the British Journal of Applied Physics, Vol. 9, November 1958, pp. 428–433 explained this phenomenon in terms of resulting surface extension in the contact area due to loading (i.e., contact pressure) and the development of shear strains consequent on the transmission of torque through the contact area. In the present embodiment, backup rolls 32, 33 are constructed so as to differ in peripheral surface hardness. Backup roll 32, in this regard, has the softer peripheral surface covering. By so constructing backup roll 32 of softer material than backup roll 33, the deformation of the heated fuser roll surface caused by contact between heated fuser roll 31 and backup roll 32 will be less than that caused by contact between heated fuser roll 31 and backup roll 33. Thus, the peripheral speed of backup roll 33 will be greater than that of backup roll 32, as each roller's peripheral speed is directly proportional to the deformation of the heated fuser roll surface caused by the roller. Accordingly, a copy sheet will tend to pass through the contact area between heated fuser roll 31 and backup roll 32 at a speed which is slightly less than that at which it passes through the contact area between heated fuser roll 31 and backup roll 33. As the copy sheet passes in succession through the two contact areas, backup roll 33 tends to pull against backup roll 32, thereby causing tensioning of the copy sheet as it passes over the portion of the surface of the heated fuser roll between the two backup rolls.

The difference in deformation required to give the desired tensioning effect may be achieved in several ways, such as: (1) by varying the diameters of the two backup rolls relative to one another; i.e., by making backup roll 33 of larger diameter than that of backup roll 32; (2) by varying the relative loading of the two rollers (e.g., by shifting pivot point 35 in FIG. 2); and (3) by varying the thickness and elastic moduli of the peripheral surface coverings of the two rollers. Each of the above three ways may be used singly or in combination to give the desired tensioning effect. One suitable configuration consists of a heated fuser roll (roll 31 in FIG. 2) covered with a 0.010" thick covering of a hard rubber (for example, commercially available Dow Corning RTV 3120 rubber), backup roll 32 covered with a 0.010" thick covering of a softer rubber (for example, commercially available Dow Corning RTV 3110 rubber) and backup roll 33 covered with a 0.001" covering of the harder rubber.

The extended resident time of the copy sheet against the heated fuser roll surface attributable to the tensioning arrangement, maximizes the time for heat transfer. As the copy sheet is in contact with the heated fuser roll for a longer time interval than in a simple (i.e., one heated fuser roll and one backup roll) roll nip arrangement, effective fusing of the toner image onto the copy sheet can be achieved at a reduced operating temperature and applied pressure.

This reduction in operating temperature and pressure is accompanied by a corresponding improvement in energy efficiency over simple roll nip arrangements. Additionally, the useful life of the structural and surface properties of the fuser rollers is extended due to the reduction in force and mechanical stresses thereon. The range of useful materials for fuser roll composition is likewise enhanced as there is no longer a need to limit the selection to those materials capable of high temperature operation.

It has also been observed in laboratory experimentation, that the fuser arrangement of the present invention affords effective fusing within a broader range of temperature and pressure than achieveable in a simple roll nip arrangement.

Further, the extended nip area achieved by this arrangement obviates the need for a thick deformable surface on the heated fuser roll. Such a thick surface has in the past been desirable for producing a large "footprint" and thereby extending copy sheet resident time against the heated fuser roll surface. In accordance with the present invention, a much thinner deformable surface may be provided. This thinner surface facilitates heat transfer through the heated fuser roll surface from the internal heat source, thereby avoiding temperature droop, a phenomenon which often results due to the low conductivity of the material of the heated fuser roll surface and therefore extended time period required for heat recovery between successive fusing operations.

The use of the thinner surface additionally in the context of the present embodiment has no adverse effect on paper separation. In laboratory experimentation, it has been observed that the copy sheet after passing through the first contact area will tend to follow the heated fuser roll and while passing through the second contact area will tend to follow the backup roll, thus facilitating paper separation.

While the present invention has been particularly described with reference to the preferred embodiment thereof, it will be understood by those skilled in the art that various changes in form and detail may be made therein, without departing from the spirit and scope of the invention.

What is claimed is:

1. A toner fixing apparatus for fixing toner particles onto a copy sheet being advanced along a paper path comprising:

first, second and third cylindrical, rotatably mounted fuser rollers; and means for rotating said rollers;

said second fuser roller being positioned substantially axially parallel to said first fuser roller and being operatively associated with said first fuser roller to define a first nip to receive a copy sheet from the paper path; and said third fuser roller being positioned substantially axially parallel to said first fuser roller and being operatively associated with said first fuser roller to define a second nip to receive a copy sheet from said first nip;

said fuser rollers further being positioned so that an advancing copy sheet enters said second nip before leaving said first nip;

said second fuser roller having a lower peripheral speed than the peripheral speed of said third fuser roller whereby tension is applied to said copy sheet as it passes over the portion of the surface of said first fuser roller between said first and second nips.

2. A toner fixing apparatus for fixing toner particles onto a copy sheet being advanced along a paper path comprising:

a first cylindrical, rotatably mounted fuser roller;

means for rotating said first fuser roller; and second and third cylindrical, rotatably mounted fuser rollers;

said second fuser roller being positioned substantially axially parallel to said first fuser roller and being operatively associated with said first fuser roller to define a first nip to receive a coppy sheet from the paper path;

said second fuser roller being also operatively associated with said first fuser roller so as to rotate in peripheral contact with said first fuser roller to advance said copy sheet; and said third fuser roller being positioned substantially axially parallel to said first fuser roller and being operatively associated with said first fuser roller to define a second nip to receive a copy sheet from said first nip;

said third fuser roller being also operatively associated with said first fuser roller so as to rotate in peripheral contact with said first fuser roller;

said fuser rollers further being positioned so that an advancing copy sheet enters said second nip before leaving said first nip;

said second fuser roller having a peripheral surface of a softer material than the peripheral surface of said third fuser roller whereby tension is applied to said copy sheet as it passes over the portion of the surface of said first fuser roller between said first and second nips.

3. A toner fixing apparatus in accordance with claim 2 wherein each of said first and second fuser rollers has a peripheral surface of a deformable material and wherein said third fuser roller has a non-deformable peripheral surface.

4. A toner fixing apparatus in accordance with claim 2 wherein each of said first and second fuser rollers has a peripheral surface of rubber and wherein the peripheral surface of said third fuser roller is metal.

5. A toner fixing apparatus in accordance with claims 2 or 3 or 4 additionally comprising a pivotable metal plate for rotatably mounting each of said second and third fuser rollers at a respective end thereof, said second and third fuser rollers being mounted on said metal plate so as to be stationary relative to each other and said metal plate being free to move about a pivot point relative to a load applied to bring said second and third fuser rollers into peripheral contact with said first fuser roller.

6. A toner fixing apparatus in accordance with claim 2 wherein the diameters of said second fuser roller and said third fuser roller differ.

7. A toner fixing apparatus in accordance with claim 6 wherein the diameter of said third fuser roller exceeds the diameter of said second fuser roller.

8. A toner fixing apparatus in accordance with claim 5 wherein said pivot point is movable to vary the relative loading of said second and third fuser rollers into peripheral contact with said first fuser roller.

9. A toner fixing apparatus in accordance with claim 5 wherein the diameters of said second fuser roller and said third fuser roller differ.

10. A toner fixing apparatus in accordance with claim 9 wherein the diameter of said third fuser roller exceeds the diameter of said second fuser roller.

11. An apparatus for applying tension to at least a portion of a sheet being advanced along a paper path comprising:

first, second and third rotatably mounted rollers; and means for rotating said rollers to advance said sheet;

said first and second rollers being positioned in peripheral engagement for forming a first nip to receive a sheet from the paper path, and said first and third rollers being positioned in peripheral engagement for forming a second nip to receive sheets from said first nip;

said rollers further being positioned so that an advancing sheet enters said second nip before leaving said first nip;

said second roller having a lower peripheral speed than the peripheral speed of said third roller whereby tension is applied to the sheet as it passes over the portion of the surface of said first roller between said first and second nips.

* * * * *